US009556888B2

(12) United States Patent
Maurer et al.

(10) Patent No.: US 9,556,888 B2
(45) Date of Patent: Jan. 31, 2017

(54) FACE MOUNT INTERFACE FOR AN ELECTRO-HYDRAULIC ACTUATOR

(71) Applicant: Parker-Hannifin Corporation, Cleveland, OH (US)

(72) Inventors: Garrett Mitchell Maurer, Maplewood, MN (US); James Richard Prazak, White Bear Lake, MN (US)

(73) Assignee: Parker-Hannifin Corporation, Cleveland, OH (US)

( * ) Notice: Subject to any disclaimer, the term of this patent is extended or adjusted under 35 U.S.C. 154(b) by 685 days.

(21) Appl. No.: 13/895,933

(22) Filed: May 16, 2013

(65) Prior Publication Data

US 2013/0312848 A1 Nov. 28, 2013

Related U.S. Application Data

(60) Provisional application No. 61/651,025, filed on May 24, 2012.

(51) Int. Cl.

| | |
|---|---|
| ***F15B 15/20*** | (2006.01) |
| ***F15B 21/00*** | (2006.01) |
| ***F15B 15/14*** | (2006.01) |

(52) U.S. Cl.

CPC ..... *F15B 21/00* (2013.01); *F15B 15/149* (2013.01); *F15B 15/1428* (2013.01); *F15B 15/202* (2013.01); *Y10T 29/49989* (2015.01); *Y10T 137/6851* (2015.04)

(58) Field of Classification Search

CPC ... F15B 15/202; F15B 15/149; F15B 15/1433; F15B 13/0825; F15B 15/1428; F15B 21/00; Y10T 29/49989; Y10T 137/6851

USPC ..... 92/163, 169.1, 88; 91/462, 20, 466

See application file for complete search history.

(56) References Cited

U.S. PATENT DOCUMENTS 2,953,118 A * 9/1960 Flick ..... F15B 15/1433 285/189
3,279,323 A 10/1966 Asche
3,627,155 A * 12/1971 Van Der Zyl ..... E02F 3/36 137/355.17
4,651,625 A * 3/1987 Hoge ..... F01L 25/063 91/461

(Continued)

*Primary Examiner* — Michael Leslie
*Assistant Examiner* — Dustin T Nguyen
(74) *Attorney, Agent, or Firm* — Renner, Otto, Boisselle and Sklar LLP

(57) ABSTRACT

A hydraulic cylinder has a main body portion with a piston bore extending in a longitudinal direction of the main body portion from a first end to a second end of the main body portion. A first cylinder mounting bracket extends in the longitudinal direction and has at least one aperture disposed along the length of the bracket for locating and securing the hydraulic cylinder to a structure. A manifold mounting portion extends in the longitudinal direction of the main body portion and has a first fluid passageway extending in the longitudinal direction from the first end to the second end. Thus, a manifold can be mounted to the manifold mounting portion at one of a plurality of different positions and/or orientations along the length of the hydraulic cylinder while allowing fluid communication between a fluid port of the manifold and the fluid passageway of the manifold mounting portion.

18 Claims, 7 Drawing Sheets

(56) References Cited

U.S. PATENT DOCUMENTS

| | | | | |
|---|---|---|---|---|
| 5,094,143 | A * | 3/1992 | Andersen, Jr. ..... | F15B 15/1433<br>137/884 |
| 6,599,116 | B2 | 7/2003 | Lee et al. | |
| 2004/0118389 | A1 * | 6/2004 | Shaffer ..... | F02B 29/0462<br>123/563 |
| 2011/0024706 | A1 * | 2/2011 | Schwindaman ..... | B60S 9/12<br>254/93 R |

* cited by examiner

FACE MOUNT INTERFACE FOR AN ELECTRO-HYDRAULIC ACTUATOR

RELATED APPLICATIONS

This application claims the benefit of U.S. Provisional Application No. 61/651,025 filed May 24, 2012, which is hereby incorporated herein by reference.

FIELD OF INVENTION

The present invention relates generally to hydraulic actuators, and more particularly to a face mount interface allowing for a number of orientations and positions of the manifold with respect to the cylinder.

BACKGROUND

Mounts for electro-hydraulic actuators are typically located in one or more fixed positions and require special banjo bolts to affix the mount to the cylinder.

SUMMARY OF INVENTION

In order to provide more manufacturing flexibility, proposed is an electr0-hydraulic actuator mounting interface that allows for customizable orientation and location of a hydraulic manifold to a cylinder housing.

According to one aspect of the invention, a hydraulic cylinder has a main body portion with a piston bore extending in a longitudinal direction of the main body portion from a first end to a second end of the main body portion. A first cylinder mounting bracket extends in the longitudinal direction and has at least one aperture disposed along the length of the bracket for locating and securing the hydraulic cylinder to a structure. A manifold mounting portion extends in the longitudinal direction of the main body portion and has a first fluid passageway extending in the longitudinal direction from the first end to the second end. Thus, a manifold can be mounted to the manifold mounting portion at one of a plurality of different positions and/or orientations along the length of the hydraulic cylinder while allowing fluid communication between a fluid port of the manifold and the fluid passageway of the manifold mounting portion.

Optionally, the the manifold mounting portion further includes a fluid aperture selectively positioned along the length of the manifold mounting portion, the aperture extending from a mounting surface of the manifold mounting portion to the fluid passageway.

Optionally, the manifold mounting portion further includes a second fluid passageway extending in the longitudinal direction from the first end to the second end.

Optionally, the manifold mounting portion further includes a pair of fluid apertures selectively positioned along the length of the bracket, the apertures extending from a mounting surface of the manifold mounting portion to respective fluid passageways.

Optionally, the cylinder mounting bracket extends from the first end to the second end.

Optionally, the hydraulic cylinder further includes a second cylinder mounting bracket laterally juxtaposed to the first cylinder mounting bracket.

Optionally, the hydraulic cylinder is in combination with a hydraulic manifold mounted to the manifold mounting portion and fluidly connected to the fluid passageways.

Optionally, the manifold is fastened to the mounting bracket by at least one fastener.

Optionally, the at least one fastener is not a banjo bolt.

Optionally, the manifold mounting portion is a solid, monolithic structure that is formed as one piece with the cylinder housing.

Optionally, the cylinder housing is formed by casting or extrusion, the manifold mounting portion being formed with the cylinder housing as a single monolithic structure.

Optionally, the fluid passageway is parallel with the cylinder piston bore.

Optionally, the at least one aperture is a plurality of apertures regularly spaced along the length of the mounting bracket.

According to another aspect of the invention, a piston-cylinder manifold is configured to mount to the hydraulic cylinder.

Optionally, the piston-cylinder manifold includes a mounting face having fluid ports spaced correspondingly to fluid passages of the hydraulic cylinder to which the manifold is intended to be mounted.

According to another aspect of the invention, a method of manufacturing a hydraulic cylinder includes casting or extruding a body including a main body portion and a manifold mounting portion; machining the body, wherein the machining does not include machining the manifold mounting portion to include one or more apertures extending from a mounting surface to fluid passageways extending along the length of the body; and machining one or more apertures in the manifold mounting portion at a selected location along a length of the manifold mounting portion.

Optionally, the method further includes mounting the manifold to the manifold mounting portion.

Optionally, the method further includes machining a flat mounting surface on the manifold mounting portion for attachment of a corresponding flat surface of a manifold.

Optionally, the method further includes receiving a specification from a customer; and thereafter machining the one or more apertures in the manifold mounting portion at a selected location along the length of the manifold mounting portion based on the specification.

Optionally, the body is cast or extruded as a single monolithic piece.

The foregoing and other features of the invention are hereinafter described in greater detail with reference to the accompanying drawings.

BRIEF DESCRIPTION OF THE DRAWINGS

Embodiments of this invention will now be described in further detail with reference to the accompanying drawing, in which.

DETAILED DESCRIPTION

Figure 1:
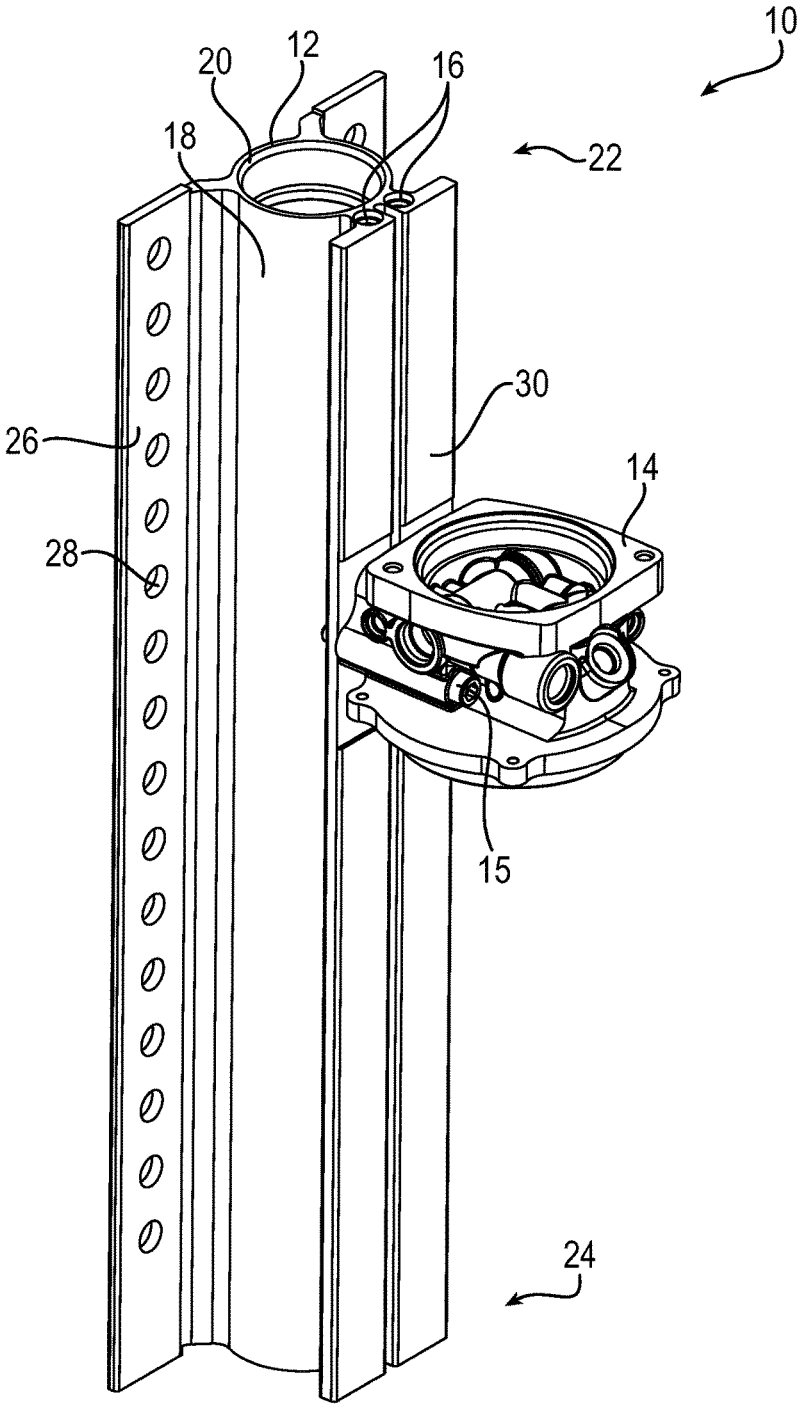
FIG. 1 is a perspective view of an electrohydraulic actuator assembly including a face mount interface in accordance with an exemplary embodiment of the present invention.
Figure 2:
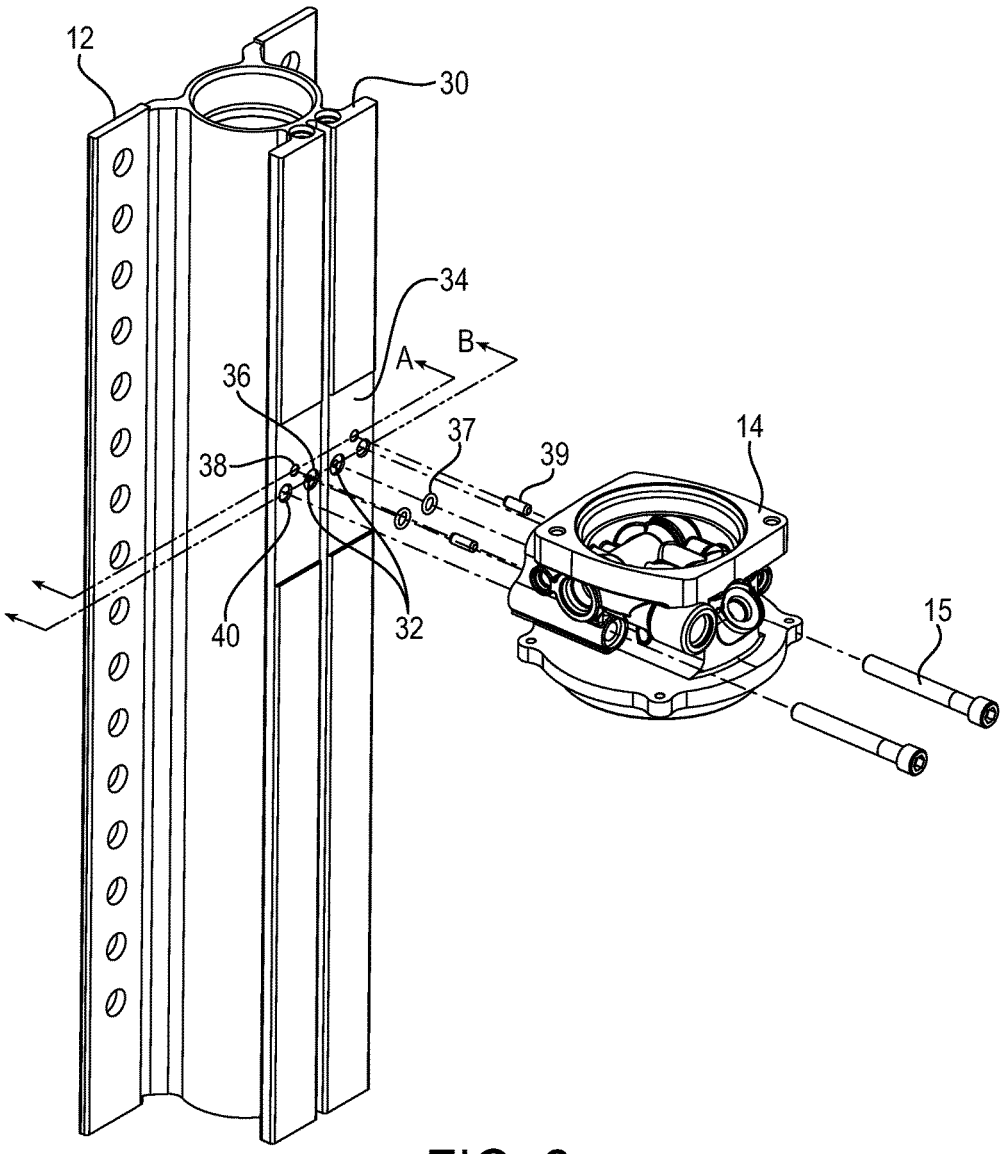
FIG. 2 is an exploded, perspective view of the assembly of FIG. 1.

Referring to FIG. 1, the face mount interface assembly for an electro-hydraulic actuator (EHA) is shown generally at 10. The assembly includes a cylinder housing 12 and a manifold 14 of the EHA secured to the cylinder body of the EHA through the use of through-hole bolts 15. The cylinder housing 12 may use an extrusion design with through holes (fluid passageways) 16 that extend along the length of the cylinder housing 12 and allow the manifold 14 to be positioned anywhere on the cylinder housing 12.

In particular, the hydraulic cylinder housing 12 includes a main body portion 18 having a main cylinder piston bore 20 extending along a longitudinal axis in a longitudinal direction from a first end 22 to a second end 24. One or more cylinder mounting brackets 26 extending in the longitudinal direction and having a plurality of apertures 28 selectively positioned along the length of the bracket may be rigidly coupled to the main body portion 18. The fluid passageways 16 may extend through a manifold mounting portion 30 which extends in the longitudinal direction from the first end to the second end and is rigidly coupled to the cylinder housing, opposite the cylinder mounting brackets.

The cylinder mounting brackets 26 may extend from the first end 22 to the second end 24, but may also extend various other lengths. For example, other embodiments might include one or more cylinder mounting brackets extending from one of the first or second ends to approximately the middle of the cylinder housing 12. In some embodiments, the cylinder body may include only one mounting bracket 23, while others may include a second cylinder mounting bracket laterally juxtaposed to the first cylinder mounting bracket, as shown in the figures.

Referring now to FIGS. 4-7, the manifold mounting portion 30 may include one or more fluid passageways 16, but preferably includes two fluid passageways 16 that extend parallel to each other and to the cylinder piston bore 20. The manifold mounting portion 30 may include one or more, preferably two, fluid apertures 32 selectively positioned along the length of the bracket 30, the aperture extending from a mounting (register) surface 34 of the manifold mounting portion 30 to the respective fluid passageways 16 to provide fluid communication between fluid passageways in an attached manifold and the fluid passageways 16 of the cylinder housing 12. The mounting surface 34 may be, for example, a separately machined, rectangular pad that allows for proper hydraulic sealing between the manifold and the cylinder body. The fluid apertures 32 may include counterbores 36 for receiving respective seal members 37 (for example, O-rings) to seal corresponding manifold hydraulic ports 52 to the fluid apertures 32.

The manifold mounting portion 30 may also include positioning holes 38 for receiving positioning pins 39 (received in corresponding positioning holes 41 on the manifold) used to precisely locate the manifold 14 with respect to the cylinder housing 12.

The manifold may be fastened to the mounting bracket by a plurality of fasteners 15 (e.g., bolts) extending through holes 43 in the manifold and fastened at, for example, fastener holes 40 (e.g., threaded holes). In exemplary embodiments, the fasteners are not banjo bolts. Rather, the fasteners are dedicated fasteners and fluid communication is provided through the separately formed fluid apertures 32.

In some embodiments, the manifold mounting portion 30 is a solid, monolithic structure that is formed as one piece with the cylinder housing 20. For example, the cylinder housing 20 may be formed by casting or extrusion, the manifold mounting portion 30 being cast or extruded with the cylinder housing 20 as a single monolithic structure. The one or more cylinder mounting brackets may be similarly formed as part of the monolithic structure.

The hydraulic cylinder housing 12 may be formed, for example, by extruding the body as a single monolithic piece including the cylinder mounting bracket 26, the cylinder housing 20, and the manifold mounting portion 30. Then, the body may be machined to include one or more of the other-described features (or other features not described herein), but not to include the one or more apertures 32 in the manifold mounting portion that extend from the mounting surface 34 to the fluid passageways 16 extending along the length of the body 12. Then, an order from a customer may be received. From such an order, the location and orientation of the manifold 14 (for example, the orientation shown in FIG. 1, or one in which the manifold is rotated 180 degrees about an axis parallel to the axes of the locating pins 39 and fasteners 15) may be determined. Thereafter, one or more apertures in the manifold mounting portion at a desired location may be machined.

Alternatively, the cylinder mounting bracket(s) 26 may be separately formed and suitably mounted to the main body portion by, e.g., welding or the like.

Such a process allows the body may be machined to include all features except those associated with the mounting of the manifold 14 so that upon receipt of customized orders, the cylinder body may be quickly and efficiently finished. This process results in smaller inventory requirements, quick order fulfillment, and flexible configurations for the customer.

Figure 3:
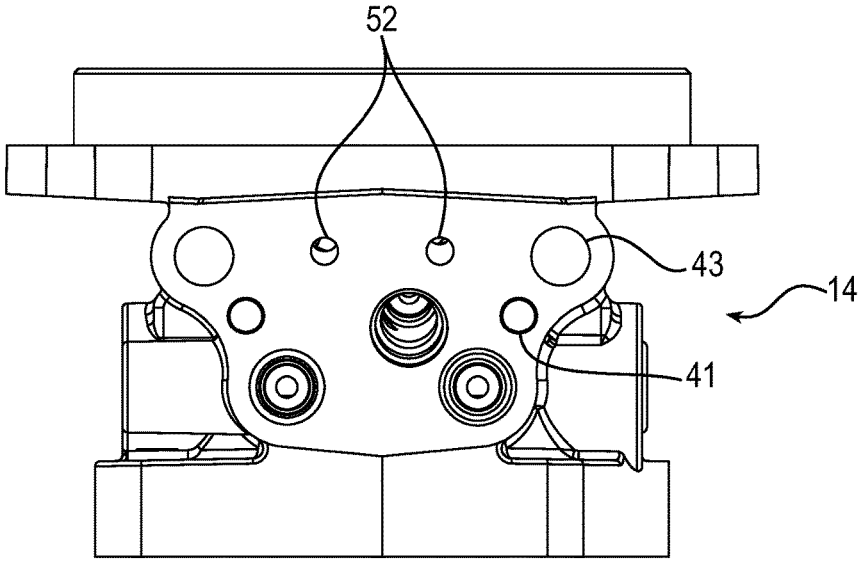
FIG. 3 is a plan view of the register surface of the manifold of the electrohydraulic actuator assembly of FIG. 1.
Figure 4:
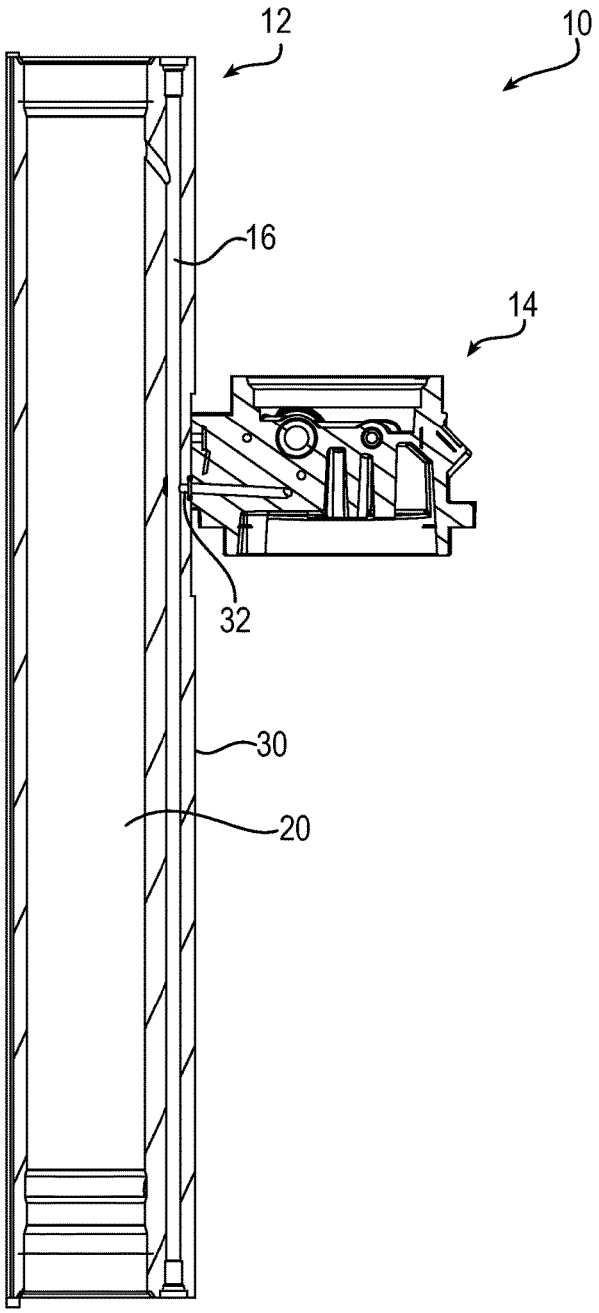
FIG. 4 is a longitudinal cross-sectional view of the assembly of FIG. 1.
Figure 5:
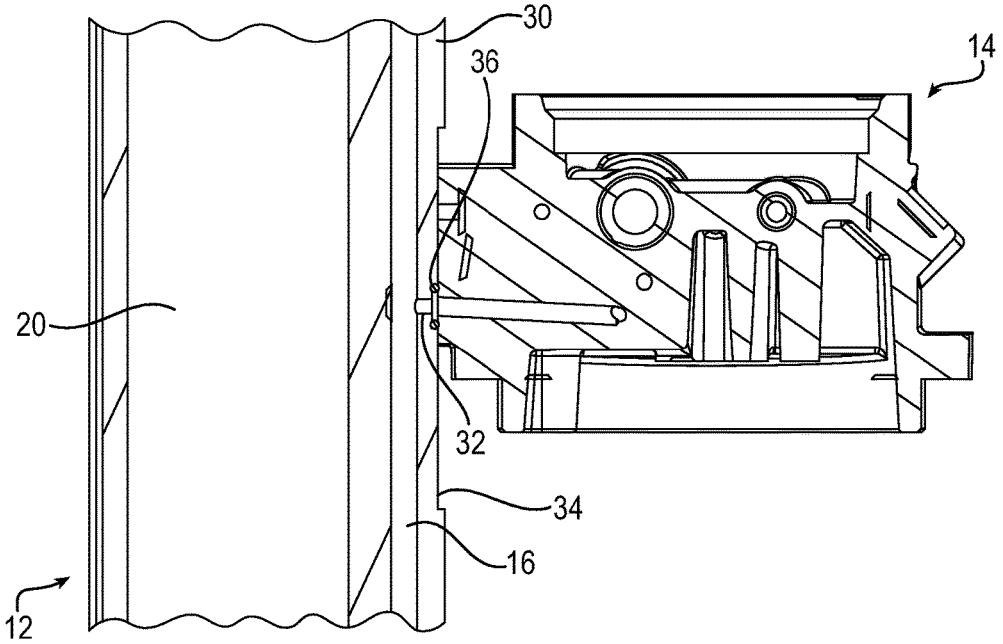
FIG. 5 is a detailed cross-sectional view of the cylinder and mount interface of the assembly shown in FIG. 4.
Figure 6:
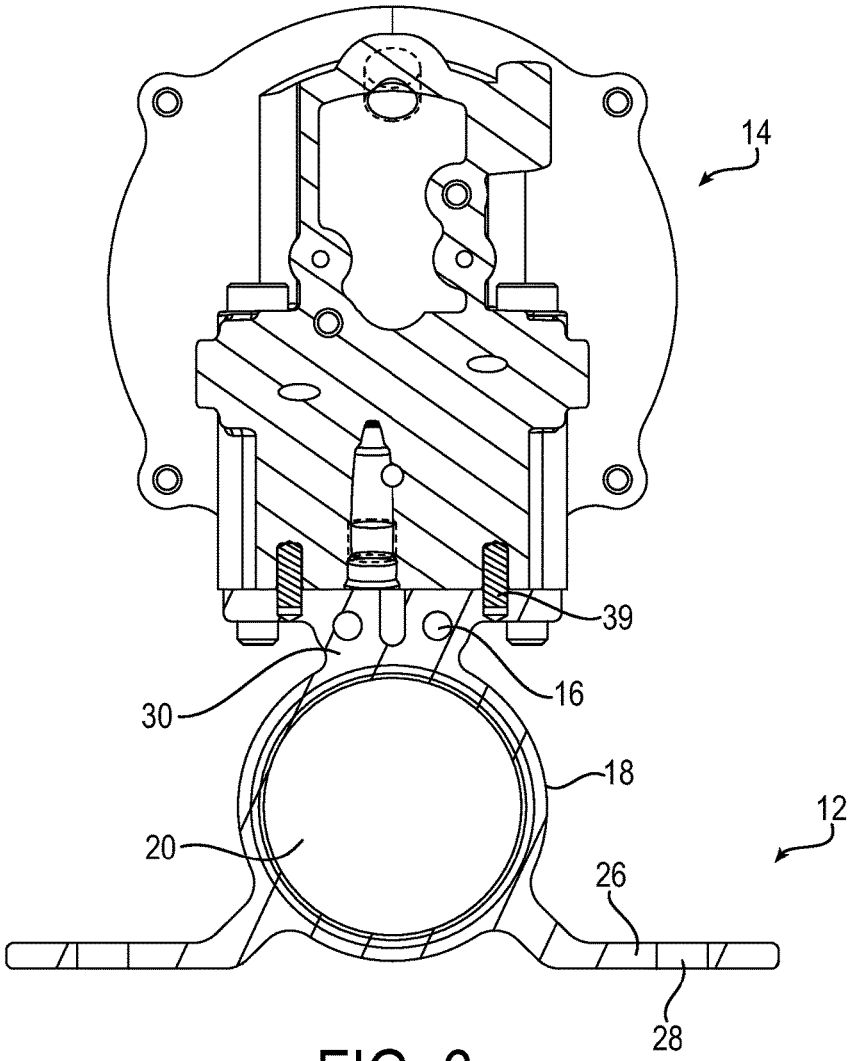
FIG. 6 is a transverse cross-sectional view of the assembly of FIG. 1 taken at section A shown in FIG. 2.
Figure 7:
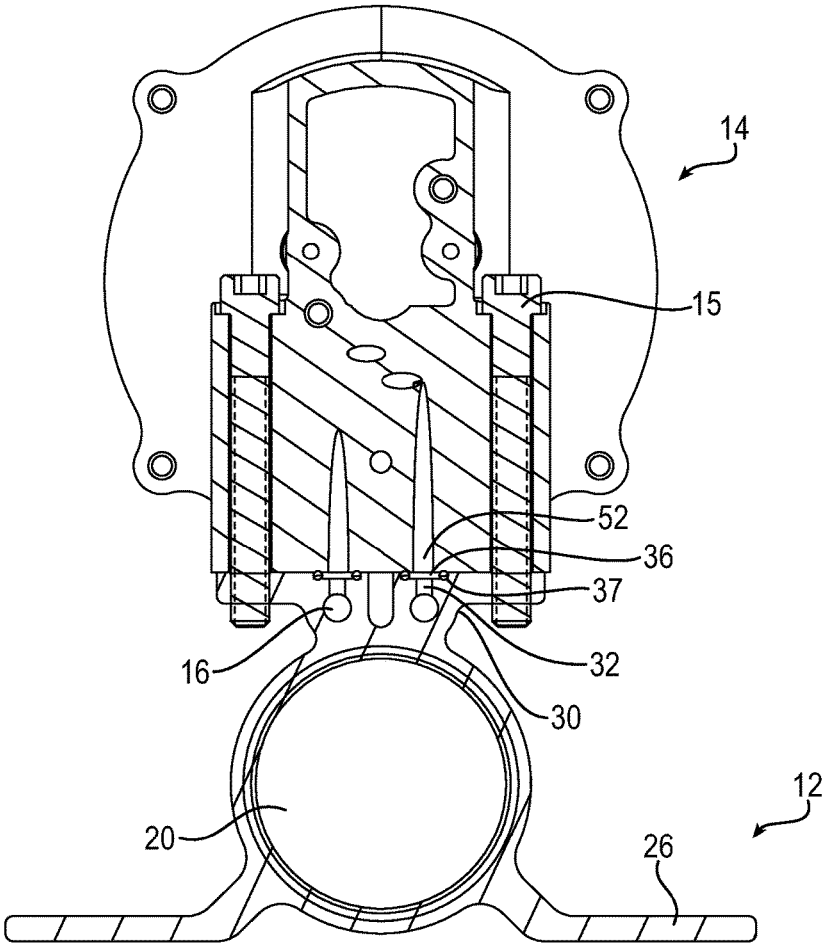
FIG. 7 is a transverse cross-sectional view of the assembly of FIG. 1 taken at section B shown in FIG. 2.

FIG. 3 shows an example port configuration used on the manifold 14. The through holes 43 where bolts 15 connect to threaded holes 40 is shown. The method of putting the holes through the manifold allows for a low cost die cast manifold 14 that allows minimal additional material and significantly reduces the profile of the assembly 10. The hydraulic ports 52 communicate to the fluid apertures 32 on the cylinder housing 12.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A hydraulic cylinder comprising:

a main body portion having a cylinder piston bore extending in a longitudinal direction of the main body portion from a first end to a second end of the main body portion;

a first cylinder mounting bracket extending in the longitudinal direction and having at least one aperture disposed along the length of the bracket for locating and securing the hydraulic cylinder to a structure; and a manifold mounting portion extending in the longitudinal direction of the main body portion and having a pair of fluid passageways extending in the longitudinal direction from the first end to the second end, the manifold mounting portion having a face mounting interface extending along the length thereof that enables mounting thereto of a manifold at one of a plurality of different positions along the length of the hydraulic cylinder while allowing fluid communication between fluid ports of the manifold and the fluid passageways of the manifold mounting portion, and wherein the fluid passageways are disposed on opposite sides of a longitudinal plane that is perpendicular to the face mounting interface of the manifold mounting portion.

2. The hydraulic cylinder of claim 1, wherein the manifold mounting portion further includes a pair of fluid apertures selectively positioned along the length of the manifold mounting portion, the fluid apertures extending from a mounting surface machined on the face mounting interface of the manifold mounting portion to the fluid passageways, respectively.

3. The hydraulic cylinder of claim 1, wherein the first cylinder mounting bracket extends from the first end to the second end.

4. The hydraulic cylinder of claim 1, further comprising a second cylinder mounting bracket laterally juxtaposed to the first cylinder mounting bracket.

5. The hydraulic cylinder of claim 1, in combination with a hydraulic manifold mounted to the manifold mounting portion and fluidly connected to the fluid passageways of the manifold mounting portion.

6. The combination of claim 5, wherein the manifold is fastened to the manifold mounting portion by at least one fastener.

7. The combination of claim 6, wherein the at least one fastener is not a banjo bolt.

8. The hydraulic cylinder of claim 1, wherein the manifold mounting portion is a solid, monolithic structure that is formed as one piece with the cylinder housing.

9. The hydraulic cylinder of claim 1, wherein the cylinder housing is formed by casting or extrusion, the manifold mounting portion being formed with the cylinder housing as a single monolithic structure.

10. The hydraulic cylinder of claim 1, wherein the fluid passageways are parallel with a longitudinal axis of the cylinder piston bore.

11. The hydraulic cylinder of claim 1, wherein the at least one aperture is a plurality of apertures regularly spaced along the length of the mounting bracket.

12. A manifold configured to mount to the hydraulic cylinder of claim 1.

13. The manifold of claim 12, further comprising a mounting face having fluid ports spaced correspondingly to fluid passages of the hydraulic cylinder to which the manifold is intended to be mounted.

14. The hydraulic cylinder of claim 1, wherein the manifold mounting portion is configured to enable mounting of the manifold to the manifold mounting portion at one of a plurality of different orientations.

15. A hydraulic cylinder comprising:

a main body portion having a cylinder piston bore extending in a longitudinal direction of the main body portion from a first end to a second end of the main body portion;

a first cylinder mounting bracket extending in the longitudinal direction and having at least one aperture disposed along the length of the bracket for locating and securing the hydraulic cylinder to a structure; and a manifold mounting portion extending in the longitudinal direction of the main body portion and having a pair of fluid passageways extending in the longitudinal direction from the first end to the second end, the manifold mounting portion configured for mounting thereto of a manifold at one of a plurality of different positions along the length of the hydraulic cylinder while allowing fluid communication between fluid ports of the manifold and the fluid passageways of the manifold mounting portion; and wherein the manifold mounting portion further includes a pair of fluid apertures selectively positioned along the length of the manifold mounting portion, the apertures extending from a mounting surface of the manifold mounting portion to the fluid passageways, respectively.

16. The hydraulic cylinder of claim 15, wherein the manifold mounting portion is configured to enable mounting of the manifold to the manifold mounting portion at one of a plurality of different orientations.

17. The hydraulic cylinder of claim 15, wherein the mounting surface is machined flat.

18. The hydraulic cylinder of claim 15, in combination with a hydraulic manifold mounted to the manifold mounting portion and fluidly connected to the fluid passageways of the manifold mounting portion.

* * * * *